US006899554B1

(12) United States Patent
Osada

(10) Patent No.: US 6,899,554 B1
(45) Date of Patent: May 31, 2005

(54) DUAL ACTION MECHANICAL ASSISTED CONNECTOR

(75) Inventor: Tsuyoshi Osada, Farmington Hills, MI (US)

(73) Assignee: JST Corporation, Farmington Hills, MI (US)

( * ) Notice: Subject to any disclaimer, the term of this patent is extended or adjusted under 35 U.S.C. 154(b) by 0 days.

(21) Appl. No.: 10/826,340

(22) Filed: Apr. 19, 2004

(51) Int. Cl.[7] ..... H01R 13/62
(52) U.S. Cl. ..... 439/157
(58) Field of Search ..... 439/157, 347, 439/489, 490, 488, 188, 160, 595, 752

(56) References Cited

U.S. PATENT DOCUMENTS

| | | | | |
|---|---|---|---|---|
| 3,392,245 | A | 7/1968 | Asick | |
| 3,478,301 | A | 11/1969 | Conrad et al. | |
| 3,488,623 | A | 1/1970 | Stephenson et al. | |
| 4,075,444 | A | 2/1978 | Hollingsead et al. | |
| 4,236,190 | A | 11/1980 | Hollingsead et al. | |
| 4,332,432 | A | 6/1982 | Colleran | |
| 4,586,771 | A | 5/1986 | Kraemer et al. | |
| 4,684,194 | A | 8/1987 | Jenkins et al. | |
| 5,252,089 | A | 10/1993 | Hatagishi et al. | |
| 5,681,175 | A | 10/1997 | Busse et al. | |
| 5,775,957 | A | 7/1998 | Fink et al. | |
| 5,810,612 | A | 9/1998 | Flask et al. | |
| 5,873,745 | A | 2/1999 | Duclos et al. | |
| 5,919,053 | A * | 7/1999 | Tsuji et al. | 439/157 |
| 5,938,458 | A | 8/1999 | Krehbiel et al. | |
| 5,967,809 | A | 10/1999 | Fink et al. | |
| 6,113,407 | A | 9/2000 | Martin | |
| 6,142,826 | A | 11/2000 | Bourillon | |
| 6,162,072 | A * | 12/2000 | Hoyer et al. | 439/157 |
| 6,168,445 | B1 * | 1/2001 | Seutschniker et al. | 439/157 |
| 6,213,795 | B1 | 4/2001 | Drescher et al. | |
| 6,217,354 | B1 | 4/2001 | Fencl et al. | |
| 6,270,376 | B1 * | 8/2001 | Fink et al. | 439/595 |
| 6,305,957 | B1 * | 10/2001 | Fink et al. | 439/157 |
| 6,312,272 | B1 | 11/2001 | Gaupp et al. | |
| 6,325,648 | B1 | 12/2001 | Bilezikjian et al. | |
| 6,345,995 | B1 * | 2/2002 | Bigotto et al. | 439/157 |
| 6,361,336 | B1 * | 3/2002 | Zhao et al. | 439/157 |
| 6,361,337 | B2 | 3/2002 | Kurimoto | |
| 6,361,356 | B1 * | 3/2002 | Heberlein et al. | 439/489 |
| 6,471,527 | B2 | 10/2002 | Fukamachi et al. | |

(Continued)

*Primary Examiner*—Ross Gushi
*Assistant Examiner*—Phuongchi Nguyen
(74) *Attorney, Agent, or Firm*—Donald R. Studebaker; Nixon Peabody, LLP

(57) ABSTRACT

A lever-type electrical connector assembly reduces the connection mating forces required to mate female and male connectors. The connector assembly employs a first connector with cam follower projections, a base housing with cam grooves and a sliding guide rail, a slide lever housing including a sliding projection and a sliding guide rail, and a cover housing pivotally mounted on the base housing, the cover housing having a sliding projection. As the cover housing is rotated from an open to a closed position, it engages the sliding projection in the guide rail to permit rotation of the lever housing. This rotation engages the sliding projection in the guide rail. As the lever housing is rotated from an open to a closed position, it rotates the cam grooves to engage the cam follower projections thereby drawing the first connector into the base housing to a connected position.

18 Claims, 9 Drawing Sheets

U.S. PATENT DOCUMENTS 6,488,516 B2 12/2002 Osawa et al.
6,551,118 B2 4/2003 Langolf et al.
6,558,176 B1 5/2003 Martin et al.
6,565,372 B2 5/2003 Bakker et al.
6,638,085 B1 10/2003 Martin
6,641,423 B1 * 11/2003 Giro ..... 439/347
6,644,991 B2 11/2003 Martin
6,824,406 B1 * 11/2004 Sharples et al. ..... 439/157

* cited by examiner

DUAL ACTION MECHANICAL ASSISTED CONNECTOR

FIELD OF THE INVENTION

The invention relates generally to electrical connector assemblies. More particularly, the invention relates to an electrical connector assembly with a lever mechanism to securely mate and un-mate the connectors with a reduced mating force as a cover housing and a lever housing are rotated.

BACKGROUND OF THE INVENTION

Electrical connector assemblies used in automotive and other applications often employ a large number of terminals and therefore require a large mating force to ensure a secure connection between the male and female connectors. Significant frictional forces from the terminals and housings must be overcome to properly join the connectors. However, assembly specifications for these connector assemblies include maximum mating force limits to prevent damage to the connectors or terminals during mating and to insure that an operator can easily and reliably mate the two connectors. These opposing constraints must both be satisfied for a connector assembly to function properly.

Conventional electrical connectors have employed levers, cams, slides, and a variety of mechanical devices to assist operators in joining those connectors that contain a large number of terminals and therefore provide significant frictional resistance. One approach used to overcome high mating forces is to employ a lever as a mechanical assist device with which to join the connectors. Lever-type devices rely on an increased moment to overcome frictional forces by applying a mating force at a distance from the fulcrum. Similarly, the use of cam systems rely upon a similar transfer of forces over distances by transferring non-linear motion into linear movement and as such, a greater linear distance between two connectors may be spanned by moving the cam over a relatively smaller non-linear distance. Connectors are drawn together to a mated position by moving the cam and engaging a cam follower.

While these methods of converting smaller applied forces into larger mating forces have been employed in the past, problems occur when the connectors are not properly aligned prior to applying the mating force, or when the connectors become misaligned as the mating force is applied. This can result from improper initial alignment of the connectors, as well as misalignment due to a fluctuating or inconsistent applied force. Prior attempts to overcome these challenges have fallen short in suitably addressing both concerns simultaneously. That is, there is a lack of a suitable connector that may apply an appropriately large and uniform mating force while ensuring the connection is properly made along the mating axis without either connector becoming misaligned.

For example, U.S. Pat. No. 6,217,354 appears to disclose an electrical connector with an actuating lever that is pivotally mounted to one side of the connector assembly. The actuating lever includes a cam groove. Additionally, a slide member is mounted on the actuating lever and moves linearly as the actuating lever pivots. The slide member includes a cam follower projection that engages in the cam groove of the actuating lever. The slide member also has a second cam groove. The second side of the connector assembly has a second cam follower projection that engages in the second cam groove of the slide member. As the actuating lever pivots, the slide member moves linearly relative to both sides of the connector as the cam follower projections engage the cam grooves, and the connector sides mate and un-mate in response to the lever action. However, the '354 patent fails to disclose means with which to suitably align the entire connector assembly during the mating action while simultaneously guarding against actuation of the cam mechanism when the connector is not properly mated.

Additionally, U.S. Pat. No. 5,938,458 appears to disclose an electrical connector assembly with an actuating lever pivotally mounted to a first connector. The actuating lever has a cam groove formed therein. A second connector has a cam follower projection to engage in the cam groove of the actuating lever. The connectors are mated and un-mated in response to the rotation of an actuating lever. The '458 patent, however, fails to disclose means with which to suitably align the connectors prior to engaging the cam system as well as to overcome higher mating forces required by multi-pin and multipart connectors.

U.S. Pat. No. 5,681,175 is another example of an electrical connector that appears to employ a camming system for mating and unmating a pair of electrical connectors. The '175 patent discloses a lock slide member mounted on one of the housings and movable along a path transverse to the mating axis. The lock slide member includes one cam track, while the other housing has a cam follower projection. As the lock slide member is moved, the cam follower projection projects into the cam track, and the connectors are mated. While the '175 patent employs a camming system, it fails to disclose means with which to suitably align the connectors during the mating process, and further fails to disclose a mechanism to overcome higher mating forces required in multi-pin and multipart connector applications. The slide mechanism of the '175 patent produces a significantly smaller mechanical advantage which may result in an inadequate applied mating force.

None of the previous electrical connector assemblies adequately generate the large mating force required to join male and female multi-pin connector structures while properly aligning the connectors to avoid skewing while they are mated.

What is needed is a new type of electrical connector assembly that provides suitably large mating forces that are substantially constant during the mating process while providing a guided system where the connectors may not be misaligned prior or during the mating process.

SUMMARY OF THE INVENTION

The present invention relates to an electrical connector assembly and method for establishing and maintaining electrical contact between conductive members to be joined by employing a lever mechanism to securely mate and un-mate the connectors with a reduced mating force as a cover housing and a lever housing are rotated.

The present invention provides a simple, powerful, and inexpensive electrical connector assembly to securely and confidently join male and female electrical connector structures to ensure electrical continuity and complete electrical circuits.

The task of securely and reliably joining multi-pin electrical connectors presents a difficult challenge as the number of pins increases and the corresponding required mating forces likewise increase. With large forces necessary, an alignment error of the male and female structures may result in inordinately high stress on the individual pins resulting in cracked conductors or damaged insulators, as well as pushed pins that fail to meet and join a corresponding receptacle. These maladies then result in faulty or intermittent connections and greatly increase product costs as extensive troubleshooting may be required to detect the faulty assembly once the product is assembled.

No previous connector assembly employs a lever-type connector assembly with a slide lever housing employing a cam groove-cam follower projection coupled with sets of guide rails to ensure the mating forces are applied along the proper mating axis and are substantially constant during the mating process.

The present lever-type electrical connector assembly invention reduces required connecting mating forces by employing a connector structure that includes two cam follower projections. The housing assembly includes a base housing for receiving the connector structure. The base housing includes two cam grooves and a sliding guide rail. Also, a slide lever housing is mounted on the base housing. The slide lever housing includes a sliding projection engaged in a sliding guide rail. The slide lever housing also has a second sliding guide rail that receives a second sliding projection that is part of a cover housing. The cover housing is pivotally mounted on the base housing.

The present invention eliminates alignment errors while simultaneously reducing the required mating forces by means of a lever assembly and camming system that provides a dual action mechanical assist to establish an intimate electrical connection between male and female connector structures. The present invention employs a novel cam groove geometry that results in mating forces that are substantially constant throughout the mating operation.

The method of the present invention allows users to securely and reliably mate connectors with large numbers of pins and high mating forces, while at the same time preventing alignment errors, eliminating intermittent connections, and improving reliability of the overall product.

BRIEF DESCRIPTION OF THE DRAWINGS

The above-mentioned and other features and objects of this invention and the manner of attaining them will become more apparent, and the invention itself will be better understood by reference to the following description of embodiments of the invention taken in conjunction with the accompanying figures where.

DETAILED DESCRIPTION OF THE INVENTION

The invention is described in detail with particular reference to certain preferred embodiments, but within the spirit and scope of the invention, it is not limited to such embodiments. It will be apparent to those of skill in the art that various features, variations, and modifications can be included or excluded, within the limits defined by the claims and the requirements of a particular use.

The present invention extends the functionality of current electrical connector assemblies by properly and consistently aligning multi-pin connectors and joining the structures with reduced mating forces. Once joined, the electrical connector assembly of the present invention is secured using the lever housing to ensure that the connection does not loosen or otherwise disconnect over time. This has many advantages over prior assemblies such as those providing simple cam slides, because the dual action mechanical assistance provided by the present invention significantly reduces the required mating forces while providing improved alignment consistency and reliability by way of the sliding guide rails and the novel geometry of the cam grooves.

Figure 1A:
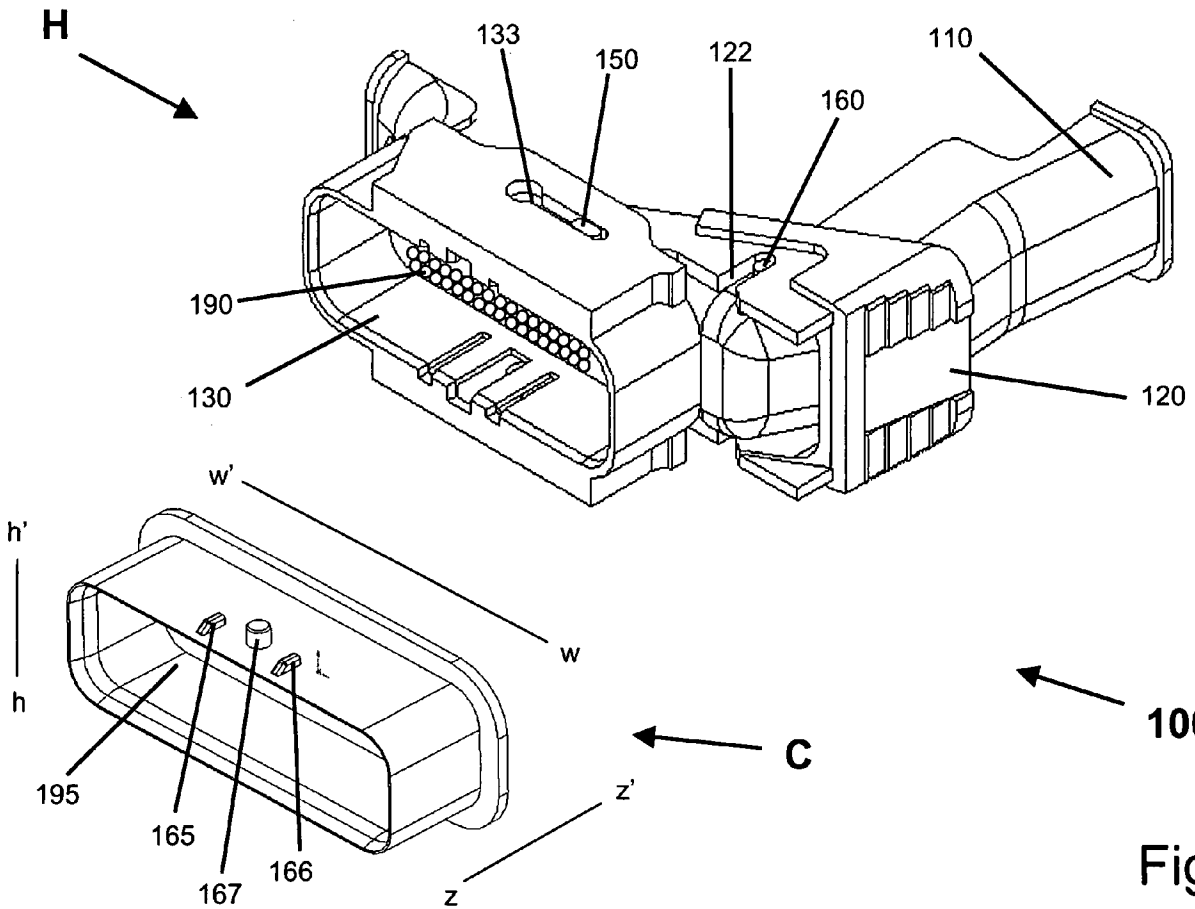
FIG. 1A is a perspective view of the connector assembly in accordance with the present invention in a fully unmated state.

FIG. 1A illustrates connector assembly 100 in a fully unmated state. It should be understood that in the following figures, housing H of the connector assembly 100 includes the dual action mechanical assist mechanism of the present invention, and that the individual male and female connector structures may be reversed between housing H and connector C without changing the overall structure of connector assembly 100 of the present invention. For brevity and convenience, reference will be made to housing H and connector C structures as depicted in FIG. 1A. The particular components of the housing H and connector C are illustrated in detail in FIGS. 1B–1E.

FIG. 1A shows housing H and connector C. In connector C, electrical contact points 195 are formed through in the front to rear direction of connector C as illustrated by directional line z-z'. The electrical contact points 195 are formed parallel to each other in several rows in the height direction of the connector C as illustrated by directional line h-h' and in several columns in the width direction of the connector C as illustrated by directional line w-w'. An electric wire W (not shown) is connected to each electrical contact point 195. In housing H, chambers 190 are formed in a reciprocal fashion to accommodate the type of electrical contact point 195 utilized in connector C. The electrical contact points 195 may be made in any number of ways, including, but not limited to blade terminals, pin terminals, block terminals, edge connectors, and the like, as long as the chambers 190 on housing H and electrical contact points 195 on connector C form the two halves of the physical junction that join to complete an electrical circuit. Connector C also includes first cam follower projection 165 and second cam follower projection 166. Similarly, two corresponding cam follower projections are present on the underside of connector C (not shown), along the h-h' axis so that there are a total of two pairs of cam follower projections on connector C.

Housing H is made of an insulating material and forms the reciprocal side of connector assembly 100 and comprises a base housing 130. Base housing 130, best illustrated in FIG. 1D, has a first sliding guide rail 133 formed to accept a first sliding projection 150. First sliding projection 150 is formed as part of lever housing 120, as shown in FIG. 1C. Lever housing 120 is formed to also include a first cam groove 152, a second cam groove 154, and second sliding guide rails 122 which accept second sliding projections 160. The second sliding projections 160 are formed as part of cover housing 110, one such projection illustrated in FIG. 1B, with the second projection extending from the opposing side of cover housing 110. Cover housing 110 is pivotally mounted on the base housing 130 and forms a protective cover shielding the point of electrical contact between connector C and housing H in connector assembly 100 as does back wall 126 of the lever housing 120. Optionally, connector C and housing H may also be lined with a flexible impervious material to prevent liquid and vapor from reaching the electrical connection point of contact.

Figure 1B:
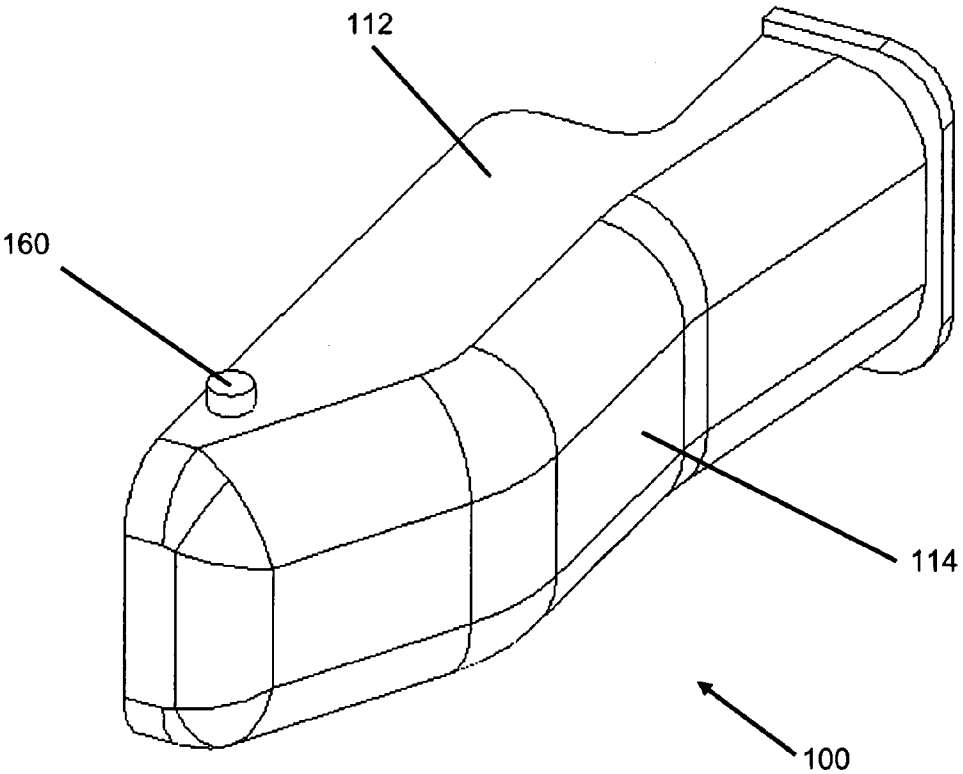
FIG. 1B is perspective view of the cover housing of the present invention.
Figure 1C:
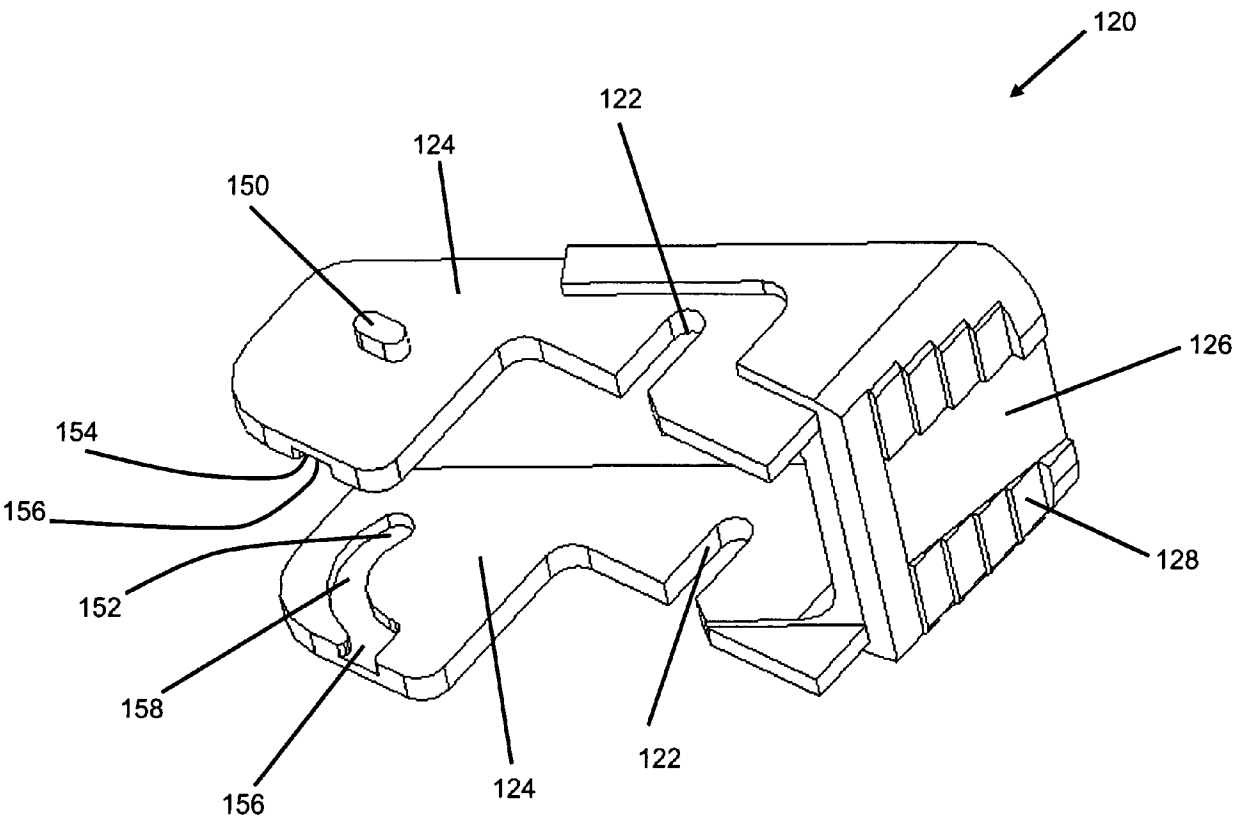
FIG. 1C is perspective view of the lever housing of the present invention.
Figure 1D:
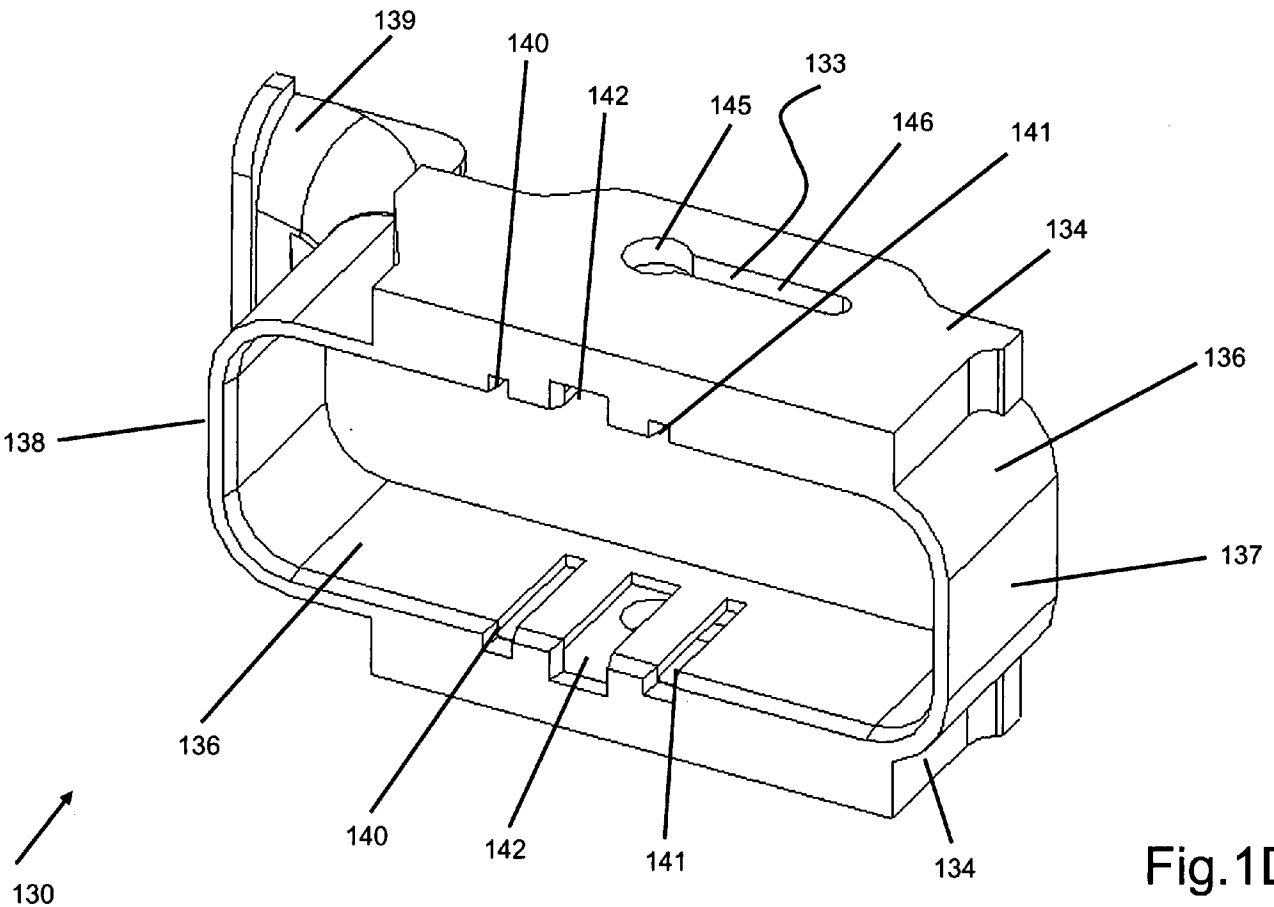
FIG. 1D is a perspective view of the base housing of the present invention.
Figure 1E:
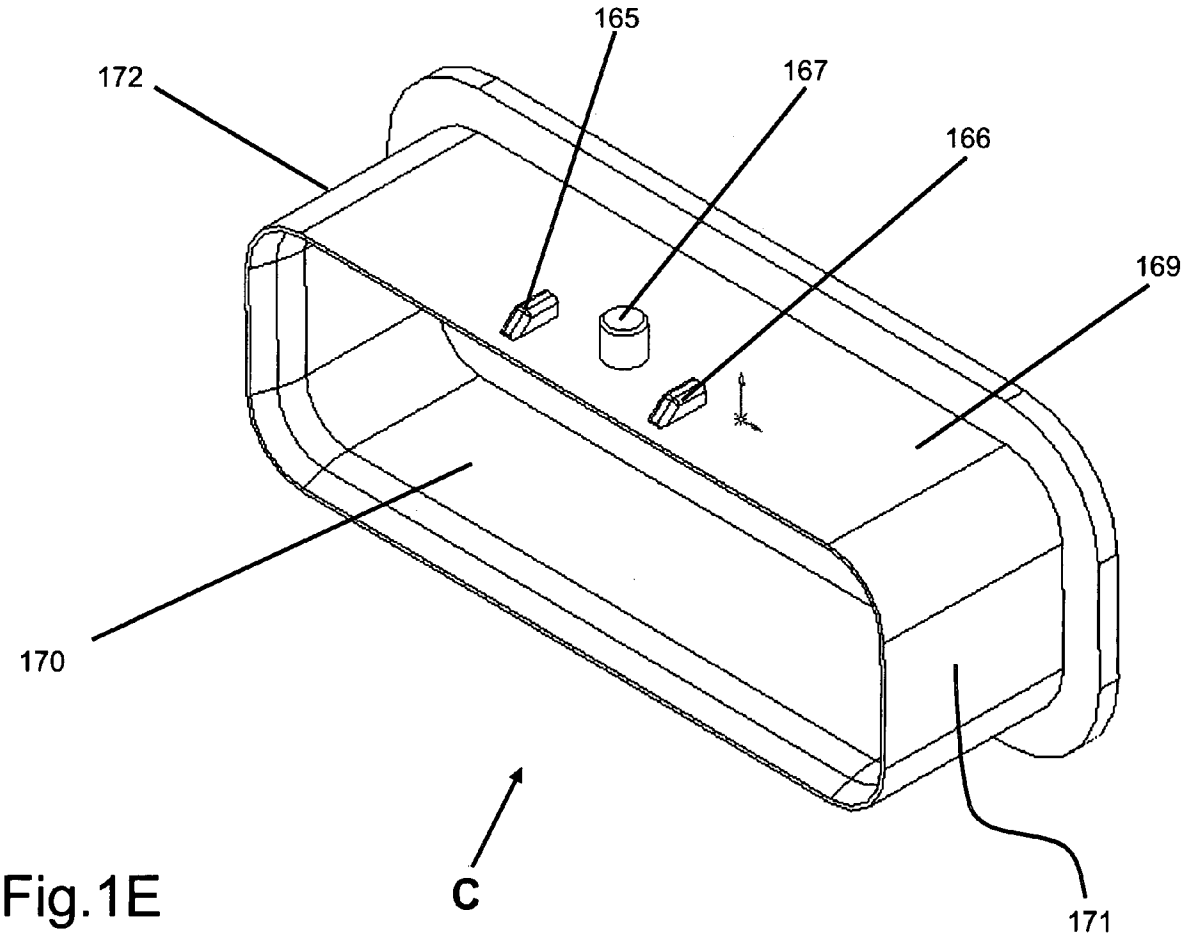
FIG. 1E is a perspective view of the mating connector of the present invention.

With reference now to the details of FIGS. 1B–1E, each of the four components which make up the connector assembly 100 are separately illustrated. As noted above, the components include connector C and cover housing 110, lever housing 120, and base housing 130 combining to form housing H. As also mentioned hereinabove, the cover housing 110 forms a protective cover shielding the electrical connections made between the housing H and connector C as do side walls 124 and back wall 126 of the lever housing 120. As shown in FIG. 1B, cover housing 110 is a three-sided housing having sidewalls 112 and a back wall 114. Each of the sidewalls 112 include one of the projections 160 each being received in one of the second sliding guide rails 122 of the lever housing 120.

As further shown in FIG. 1C, lever housing 120 similarly includes two side walls 124 and a back wall 126. The back wall 126 includes ridges 128 which aid the user in engaging the lever housing 120 such that during pivoting of the lever housing 120, the finger or thumb of the user does not readily slip off the lever housing. The side walls 124 of the lever housing 120 are substantially planar with sliding projections 150 extending from each of the side walls 124. The thickness of the sidewall 124 is such that it can be readily received by the base housing 130. While the particular configuration of the lever housing 120 is not critical, the functionality of such is as noted hereinbelow. Also, as noted hereinabove, one side wall 124 includes first cam groove 152 formed on an inside surface thereof while the opposing sidewall includes second cam groove 154. The cam grooves 152 and 154 are mirror images of one another and include lead-in portions 156 and arched portions 158. The significance of the arched portions is explained in greater detail hereinbelow.

The base housing 130 includes the first guide rails 133 formed in each of the wing walls 134, which extend substantially parallel to and spaced from a respective sidewall 136 of the base housing 130. The configuration of the first guide rails 133 includes an elongated section 146 and a circular section 145, the significance of which will be discussed in greater detail hereinbelow. The base housing 130 also includes end walls 137 and 138 with end wall 138 including a lead portion 139 for cooperating with the cover housing 110 in forming an opening to the housing H for receiving a lead wire, not shown.

An inner surface of each of the side walls 136 includes substantially parallel guide rails 140, 141, 142 for receiving the projections 165, 166, and 167 of connector C. Guide rails 140 and 141 extending alongside guide rail 142 for receiving projections 165 and 166 aiding in the proper alignment of the connector C with respect to the base housing 130.

The connector C includes side walls 169 and 170 and end walls 171 and 172 with the projections 165, 166, and 167 extending from a substantially center region of each of the side walls 169 and 170, the connector C being sized to be slidingly received within the base housing 130. The projections 165 and 166 extending outwardly a distance less than the thickness of side walls 136 of the base housing 130 while the center projection 167 extends a distance greater than the thickness of the sidewalls 136 so as to extend into the space formed between the sidewalls 136 and wing walls 134 of the base housing 130. This is so that the projections 167 can be received by the first and second cam grooves 152 and 154 of the lever housing 120. This interaction will be described in greater detail hereinbelow.

Figure 2A:
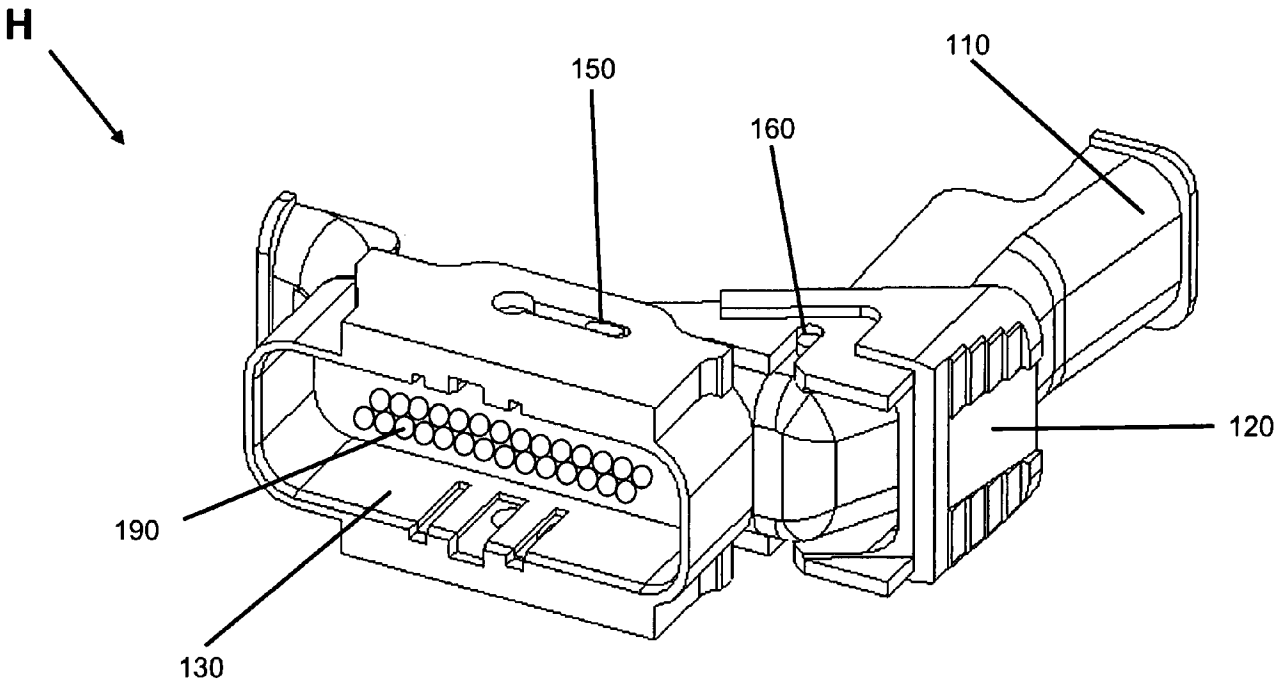
FIG. 2A is a perspective view of the connector housing just prior to beginning the mating process.
Figure 4A:
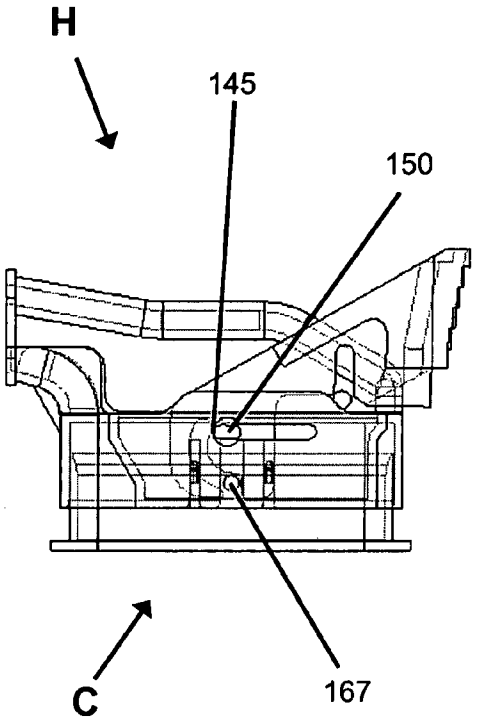
FIG. 4A is a perspective view of the connector assembly just prior to rotation of the lever housing.
Figure 4B:
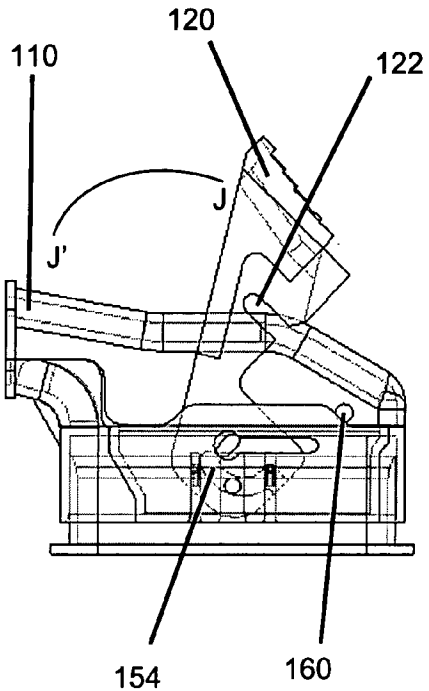
FIG. 4B is a perspective view depicting the connector assembly as the lever housing is in the process of being rotated.
Figure 4C:
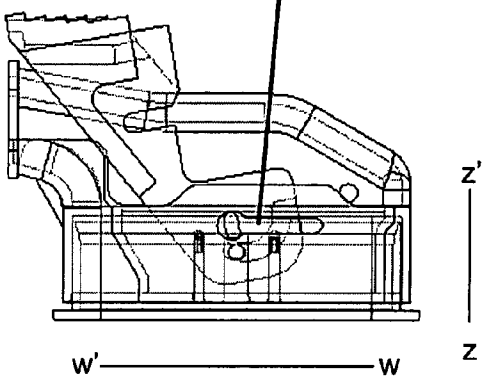
FIG. 4C is a perspective view showing the lever housing fully rotated and the connector assembly in its fully mated state.

As noted above, FIG. 2A illustrates connector assembly 100 in a fully unmated state. That is, connector C is not inserted in housing H. FIG. 2A shows housing H as it is activated to begin the mating process. For simplicity, and to better illustrate the operation of housing H, connector C is not shown in FIGS. 2A and 2B, but it should be understood that connector C is partially inserted in housing H prior to the method of practicing the present invention of mating the two structures of connector assembly 100. This arrangement is shown in FIGS. 4A, 4B, and 4C.

Figure 2B:
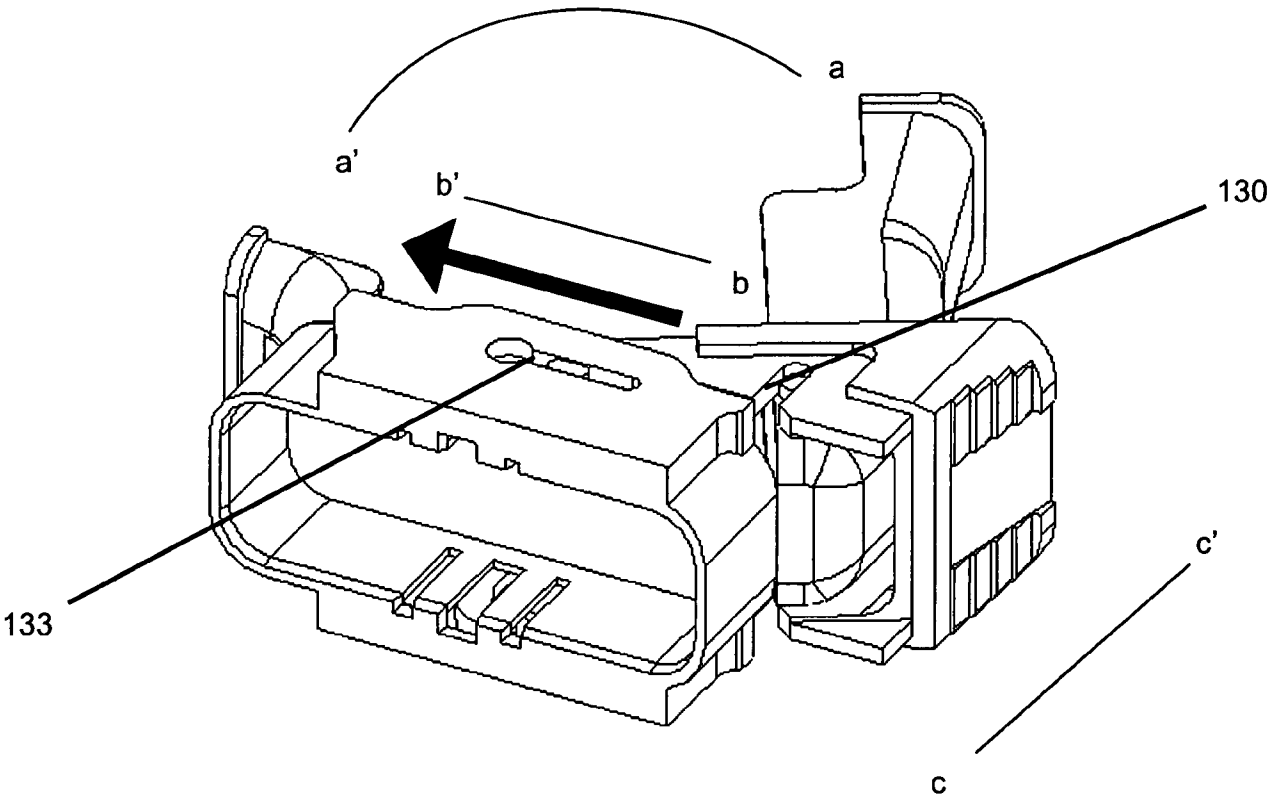
FIG. 2B is a perspective view of the connector housing showing the applied forces of the cover housing and the lever housing as the cover housing is rotated toward a mated state.

The initial operation of the present invention is further illustrated in FIGS. 2A and 2B. FIG. 2A illustrates the housing H in a fully open state, where the housing H is initially assembled, the cover housing 110 is received within the side walls 124 and in front of the end wall 126 of the lever housing 120 and the second sliding projections 160 of the cover housing are received in the second slide rails 122 of the lever housing 120 and the side walls 124 of the lever housing 120 are received in the space formed between the wing walls 134 and the sidewalls 136 of the base housing. Further, the sliding projections 150 of the lever housing are received in the respective first guide rails formed in the wing walls 134 of the base housing 130. The cover housing 110 and the base housing 130 are hingedly connected to one another and may be integrally formed with one another. Alternatively, the back wall 114 of the cover housing 110 may otherwise engage the end wall 137 of the base housing 130 to form a pivot point therebetween. In its fully-opened position, as shown in FIG. 2A, cover housing 110 and lever housing 120 significantly form housing H so as to provide improved access to chambers 190 in base housing 130. This improved access to chambers 190 in the housing's fully-opened position facilitates faster and more efficient assembly of housing H, including population of chambers 190 with reciprocal electrical contact points with which to form the physical junction that joins with electrical contact points 195 in connector C. The novel geometry formed by the combination of cover housing 110 and lever housing 120 provide improved access while minimizing the total package area.

FIG. 2B shows housing H with cover housing 110 fully-opened to begin the mating process. Cover housing 110 is set to its fully-opened state in the base housing 130. Cover housing 110 is pivotally mounted on base housing 130 and will rotate from its fully open state toward base housing 130 along directional arc a-a' during mating. As cover housing 110 is rotated, second sliding projections 160 exert pressure on second sliding guide rail 122 with force components generally in the width direction of the housing and in the front-to-rear direction of the housing H. The width direction is shown in FIG. 2B as directional line b-b' and the front-to-rear direction is shown in FIG. 2B as directional line c-c'. The corresponding force arrows in the appropriate directions are also shown.

The pressure exerted by second sliding projection 160 on second sliding guide rail 122 causes lever housing 120 to move linearly in the width direction along line b-b'. As cover housing 110 is rotated to a fully closed position, second sliding projection 160 moves linearly along direction line b-b' until first sliding projection 150 encounters a mechanical stop indicating the end point of travel 145 in first sliding guide rail 133. This mechanical stop at the end point of travel 145 is in base housing 130 in a position along direction line b-b' corresponding to the end of the full range of angular motion of cover housing 110. At this point, cover housing 110 is in its fully closed position corresponding to the end of travel along arc a-a', and first sliding projection 150 of lever housing 120 is at the end of linear travel along direction line b-b'. As sliding projection 150 reaches the end of linear travel, lever housing 120 no longer extends beyond the edges of base housing 130 and connector C. In this mated fully-closed position, total packaging size of the connector assembly 100 is minimized, thereby providing improved clearance in environments where the connector assembly 100 is utilized.

Figure 3:
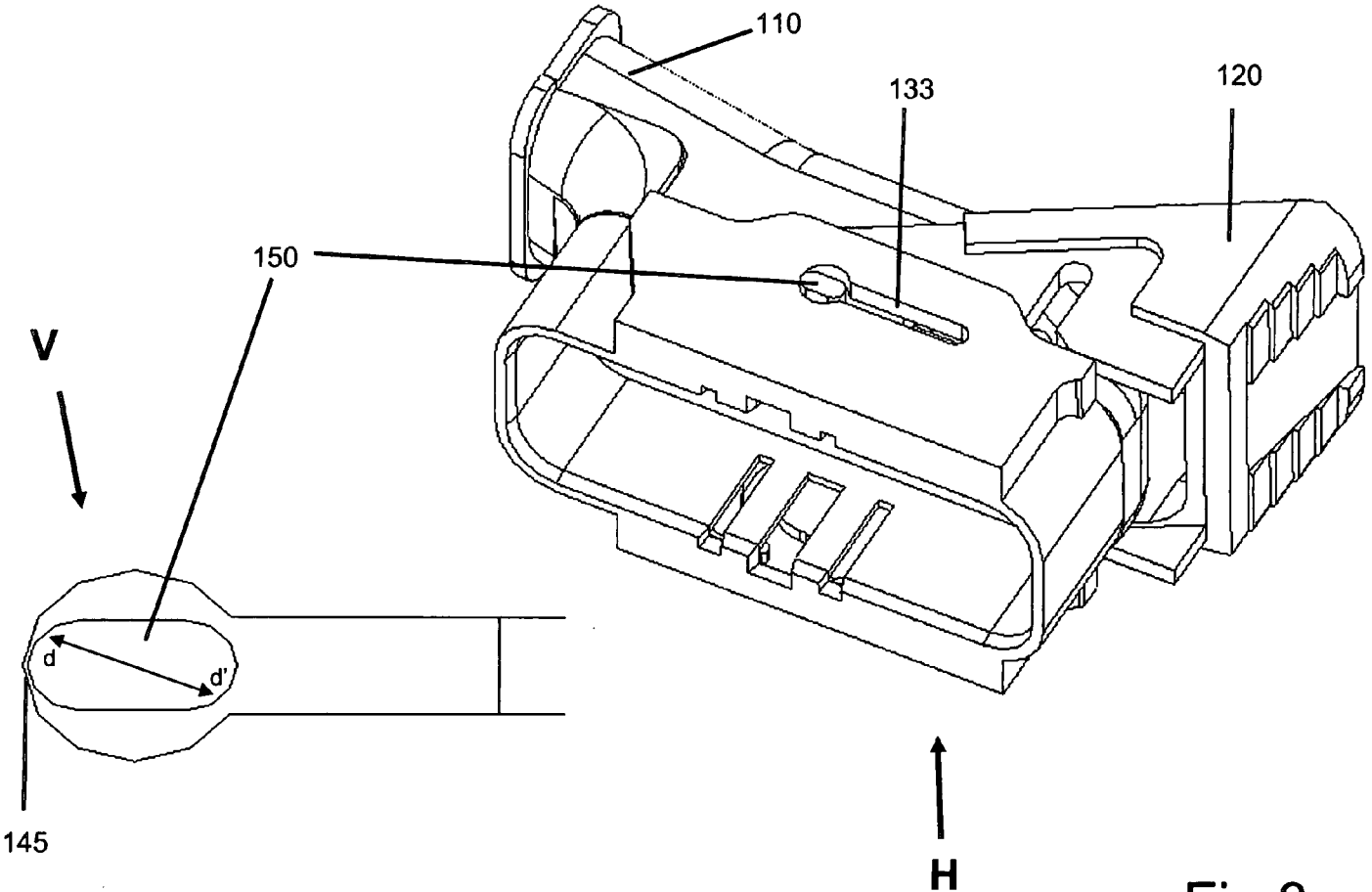
FIG. 3 is a perspective view of the connector housing showing the cover housing in a fully closed position and showing an expanded view of a first sliding projection.

Referring now to FIG. 3, once cover housing 110 has been rotated to its fully closed position, first sliding projection 150 has traveled the full range of linear motion in first sliding guide rail 133, lever housing 120 has traveled its full range of linear motion along direction line b-b' as well. An enlargement of first sliding projection 150 in this position is shown in expanded view V. The shape of first sliding projection 150 is substantially a rounded rectangle. The shape of the end point of travel 145 of first sliding guide rail 133 is substantially circular. The length of the diagonal d-d' of first sliding projection 150 is slightly smaller than the diameter of end point of travel 145, and the width of the first sliding projection 150 is slightly less than a width of the elongated portion 146 of the first sliding rail 133 to restrict the pivoting of the lever housing 120 with respect to the base housing 130 during the linear travel of the lever housing 120.

To further secure housing H, lever housing 120 is rotated in substantially the same direction as cover housing 110 was rotated along arc a-a' as was depicted in FIG. 2B. As lever housing 120 is rotated, the geometry of the first sliding projection 150 and the end point of travel 145 permits first sliding projection 150 to rotate within the circumference of end point of travel 145 shown as directional arc J-J'. By rotating first sliding projection 150 within the circumference of end point of travel 145, the connector is secured since first sliding projection 150 cannot back out of end point of travel 145 because the length of first sliding projection 150 is greater than that of the opening. Rotation of both lever housing 120 and first sliding projection 150 stop when lever housing 120 completes the rotational arc substantially along arc J-J' and meets a mechanical stop such as closed cover housing 110.

Referring now to FIGS. 4A, 4B, and 4C, at the same time lever housing 120 is rotated and turns first sliding projection 150, first cam groove 154 on lever housing 120 engages first cam follower projection 167 on connector C and second cam groove 152 engages second cam follower projection (not shown, but on the opposite side of connector C). In the illustrated embodiment, first cam groove 154 and second cam groove 152 are substantially circular arcs, and as such provide a substantially constant force in the z-z' mating direction when lever housing 120 is rotated.

As lever housing 120 is rotated, first cam groove 154 engages first cam follower projections 167, and second cam groove 152 engages the second cam follower projection. This action drives first cam follower projection 167 and second cam follower projection in the z-z' direction. The circular camming action of the cam grooves draws connector C and housing H together into a mated condition by exerting a substantially constant force in the z-z' direction. This substantially constant force, along with the guide rails 140, 141 and projections 165, 166, facilitates proper alignment of connector C and housing H as the structures are mated. Other, non-arc cam groove geometries result in differential forces, which are much more likely to skew the connector C or the housing H and result in a faulty connection or a damaged connector assembly. The rotational motion of the lever housing 120 causes a pivotal motion of the cam grooves engaging the cam follower projections, thereby causing linear motion of connector C relative to housing H along the z-z' direction, resulting in a mated connector assembly.

In FIGS. 4A, 4B, and 4C, the housing H is shown in three positions as the lever housing 120 is rotated. In FIG. 4A, first sliding projection 150 has reached the end point of travel 145, but lever housing 120 has not yet started to rotate. In FIG. 4B, lever housing 120 is in the process of being rotated along arc J-J', thereby rotating first sliding projection 150. Also, first cam groove 154 receives and engages first cam follower projection 167 and the second cam groove 152 receives and engages the second cam follower projection on the opposite side of the connector C. At this point, the arc portion of cam grooves 152 and 154 are engaging cam follower projections 165 and 166 providing a force reduction. In FIG. 4C, lever housing 120 is fully rotated, and the connection is complete. As shown in FIG. 4C, when lever housing 120 is fully rotated, first sliding projection 150 is also fully rotated and due to its configuration serves as a locking device to hold the connector assembly in its final, secure position.

If an operator must un-mate the connector assembly, the process is reversed as lever housing 120 is rotated in the opposite direction toward its initial position. This, in turn, rotates first sliding projection 150 and returns first sliding projection 150 to an unlocked position allowing first sliding projection 150 to fit through and enter the opening of first sliding guide rail 133. Simultaneously, as lever housing 120 is further rotated, the rotation forces first cam follower projection 167 and second cam follower projection back along first cam groove 154 and the second cam groove 152, respectively. This disengaging of the cam followers from the cam grooves allows connector C to withdraw from housing H. When lever housing 120 is rotated back to its starting position, cover housing 110 may then be rotated back to its initial position as well.

As cover housing 110 is rotated back, second sliding projection 160 exerts pressure on second sliding guide rail 122 with force components generally in the width direction w-w' of the housing and in the front-to-rear direction z-z' of the housing H. For reference, the width direction w-w', the front-to-rear direction, z-z' and the height direction h-h' are shown in FIG. 4A.

The pressure exerted by second sliding projection 160 on second sliding guide rail 122 causes lever housing 120 to move linearly back toward its initial position. As cover housing 110 is returned to its fully open position, second sliding guide rail 122 moves back in the reverse direction until second sliding guide rail 122 encounters the end of travel in the reverse direction by encountering second sliding projection 160, which acts as a mechanical stop. At this point, cover housing 110 is once again in its fully open position and first sliding projection 150 and lever housing 120 have been returned to their initial ends of linear travel.

While the present invention have been described in connection with a number of exemplary embodiments and implementations, the present invention is not so limited but rather covers various modifications and equivalent arrangements, which fall within the purview of the appended claims.

What is claimed is:

1. A lever-type electrical connector assembly that reduces required connecting mating forces comprising:

a first connector including a first cam follower projection and a second cam follower projection;

a base housing for connecting to the first connector, the base housing including a first guide rail, a second guide rail, and a first sliding guide rail;

a slide lever housing mounted on the base housing and including a first sliding projection engaged in the first sliding guide rail, a first cam groove for receiving the first cam follower projection and a second cam groove for receiving the second cam follower projection, the slide lever housing having a second sliding guide rail; and a cover housing having a second sliding projection engaged in the second sliding guide rail, the cover housing pivotally mounted on the base housing.

2. The lever-type electrical connector assembly of claim 1, wherein the assembly is sealed to prevent liquid and vapor penetration.

3. The lever-type electrical connector assembly of claim 1, wherein the first sliding guide rail includes a lateral stop to prevent further travel of the first sliding projection.

4. The lever-type electrical connector assembly of claim 3, wherein the lateral stop of the first sliding guide rail includes a circular region formed to provide an area for the first sliding projection to rotate as the lever housing is rotated from an unmated position to a mated position.

5. The lever-type electrical connector assembly of claim 1, wherein at least one of the first cam groove and the second cam groove is non-linear to engage at least one of the first cam follower projection and the second cam follower projection as the lever housing is rotated from an unmated position to a mated position.

6. The lever-type electrical connector assembly of claim 5, wherein the at least one non-linear cam groove is formed in the shape of an arc thereby providing a substantially constant mating force as the lever housing is rotated from an unmated position to a mated position.

7. A lever-type electrical connector assembly that reduces required connecting mating forces comprising:

a first connector including a first cam follower projection and a second cam follower projection;

a base housing for connecting to the first connector, the base housing including a first guide rail, a second guide rail and a first sliding guide rail;

a slide lever housing mounted on the base housing and including a first sliding projection engaged in the first sliding guide rail, a first cam groove for receiving the first cam follower projection and a second cam groove for receiving the second cam follower projection, the slide lever housing having a second sliding guide rail; and a cover housing having a second sliding projection engaged in the second sliding guide rail, the cover housing pivotally mounted on the base housing, wherein the cover housing is rotated from an open position to a closed position thereby engaging the second sliding projection in the second sliding guide rail to permit the movement of the lever housing from an open to a closed position thereby engaging the first sliding projection in the first sliding guide rail and where the lever housing is rotated from an unmated position to a mated position thereby rotating the first cam groove and the second cam groove to engage the first cam follower projection and the second cam follower projection thereby drawing the first connector into the base housing to a connected position.

8. The lever-type electrical connector assembly of claim 7, wherein the assembly is sealed to prevent liquid and vapor penetration.

9. The lever-type electrical connector assembly of claim 7, wherein the first sliding guide rail includes a lateral stop to prevent further travel of the first sliding projection.

10. The lever-type electrical connector assembly of claim 9, wherein the lateral stop of the first sliding guide rail includes a circular region formed to provide an area for the first sliding projection to rotate as the lever housing is rotated from an unmated position to a mated position.

11. The lever-type electrical connector assembly of claim 7, wherein at least one of the first cam groove and the second cam groove is non-linear to engage at least one of the first cam follower projection and the second cam follower projection as the lever housing is rotated from an unmated position to a mated position.

12. The lever-type electrical connector assembly of claim 11, wherein the at least one non-linear cam groove is formed in the shape of an arc thereby providing a substantially constant mating force as the lever housing is rotated from an unmated position to a mated position.

13. A method of locking a connection member into secure electrical engagement with a housing member, said method comprising:

inserting the connection member into a housing member, the connection member comprising a first cam follower projection and a second cam follower projection, and the housing member comprising:

a base housing, the base housing comprising a first guide rail, a second guide rail and a first sliding guide rail, a slide lever housing mounted on the base housing and including a first sliding projection engaged in the first sliding guide rail, a first cam groove for receiving the first cam follower projection and a second cam groove for receiving the second cam follower projection, the slide lever housing having a second sliding guide rail; and a cover housing having a second sliding projection engaged in the second sliding guide rail, the cover housing pivotally mounted on the base housing, rotating the cover housing from an open position to a closed position thereby engaging the second sliding projection in the second sliding guide rail;

sliding the lever housing from an open position to a closed position thereby engaging the first sliding projection in the first sliding guide rail;

rotating the lever housing from an unmated position to a mated position thereby rotating the first cam groove and the second cam groove to engage the first cam follower projection and the second cam follower projection thereby drawing the connection member into the base housing to a connected position.

14. The method of locking a connection member into secure electrical engagement with a housing member of claim 13, further comprising the step of sealing the connector and the housing to prevent liquid and vapor penetration.

15. The method of locking a connection member into secure electrical engagement with a housing member of claim 13 wherein the step of sliding the lever housing from an open position to a closed position is complete upon sliding the lever housing until the lever housing reaches a lateral stop.

16. The method of locking a connection member into secure electrical engagement with a housing member of claim 15, further comprising the step of rotating the lever housing and the first sliding projection from an unmated position to a mated position after the step of sliding the lever housing from an open position to a closed position is complete.

17. The method of locking a connection member into secure electrical engagement with a housing member of claim 13, wherein at least one of the first cam groove and the second cam groove is non-linear to engage at least one of the first cam follower projection and the second cam follower projection as the lever housing is rotated from an unmated position to a mated position.

18. The method of locking a connection member into secure electrical engagement with a housing member of claim 17, wherein the at least one non-linear cam groove is formed in the shape of an arc thereby providing a substantially constant mating force as the lever housing is rotated from, an unmated position to a mated position.

* * * * *